US009022625B2

(12) United States Patent
Okubo

(10) Patent No.: US 9,022,625 B2
(45) Date of Patent: May 5, 2015

(54) VEHICLE HEADLAMP

(75) Inventor: Yasuhiro Okubo, Isehara (JP)

(73) Assignee: Ichikoh Industries, Ltd., Isehara-shi (JP)

( * ) Notice: Subject to any disclaimer, the term of this patent is extended or adjusted under 35 U.S.C. 154(b) by 27 days.

(21) Appl. No.: 13/599,314

(22) Filed: Aug. 30, 2012

(65) Prior Publication Data

US 2013/0051057 A1 Feb. 28, 2013

(30) Foreign Application Priority Data

Aug. 31, 2011 (JP) ..... 2011-189227

(51) Int. Cl.
*F21V 5/00* (2006.01)
*F21S 8/10* (2006.01)

(52) U.S. Cl.
CPC ..... *F21S 48/1154* (2013.01); *F21S 48/1258* (2013.01); *F21S 48/1266* (2013.01); *F21S 48/1291* (2013.01); *F21S 48/328* (2013.01)

(58) Field of Classification Search
USPC ..... 362/543–545, 506–507, 509, 487, 520, 362/522, 311.02, 307–309, 296.05, 332
See application file for complete search history.

(56) References Cited

U.S. PATENT DOCUMENTS

| | | | | |
|---|---|---|---|---|
| 5,735,595 | A * | 4/1998 | Nederpel et al. | 362/223 |
| 7,410,279 | B2 * | 8/2008 | Kawashima et al. | 362/507 |
| 7,682,057 | B2 * | 3/2010 | Albou | 362/507 |

FOREIGN PATENT DOCUMENTS

| | | | |
|---|---|---|---|
| EP | 2 202 454 | A2 | 6/2010 |
| EP | 2 351 963 | A1 | 8/2011 |
| JP | 2010-123447 | A | 6/2010 |
| JP | 2010-153076 | A | 7/2010 |

* cited by examiner

*Primary Examiner* — Evan Dzierzynski
*Assistant Examiner* — Naomi M Wolford
(74) *Attorney, Agent, or Firm* — Foley & Lardner LLP

(57) ABSTRACT

A vehicle headlamp that is capable of optically distributing a spot portion of a light distribution pattern having a cutoff line to a cruising lane side is provided. The present invention includes semiconductor-type light sources 2L and 2R and lenses 3L and 3R. On emission surfaces 31L and 31R of the lenses 3L and 3R, peak portions 32L and 32R that form a spot portion SP of a light distribution pattern for low beam LP are respectively provided in given locations that are close to a cruising lane side with respect to optical axes ZL and ZR of the lenses 3L and 3R. As a result, the present invention can provide the vehicle headlamp that is capable of optically distributing the spot portion SP of the light distribution pattern for low beam LP having a cutoff line CL.

4 Claims, 10 Drawing Sheets

VEHICLE HEADLAMP

CROSS REFERENCE TO RELATED APPLICATIONS

This application claims priority of Japanese Patent Application No. 2011-189227 filed on Aug. 31, 2011. The content of this application is incorporated herein by reference in their entirety.

BACKGROUND OF THE INVENTION

1. Field of the Invention

The present invention relates to a vehicle headlamp that employs a semiconductor-type light source as a light source to radiate a light distribution pattern having a cutoff line (a light distribution pattern for passing) forward of a vehicle.

2. Description of the Related Art

A vehicle headlamp that employ a semiconductor-type light source as light source is conventionally known (for example, Japanese Unexamined Patent Application Publication No. 2010-123447 and Japanese Unexamined Patent Application Publication No. 2010-153076). Hereinafter, these vehicle headlamps of the related art will be described. The former vehicle headlamp is provided with a light source and a lens that is adapted to employ light from the light source as a light distribution pattern having a cutoff line to polarize and emit the light to a front side. The latter vehicle headlamp is provided with a light emitting element and a light transmission member that is adapted to emit, from the front face, light from the light emitting element as a light distribution pattern having a cutoff line.

In such vehicle headlamps, it is important to optically distribute a spot portion (a high light intensity portion or a light focusing portion) of a light distribution pattern having a cutoff line to a cruising lane side from the viewpoint of improvement of visual recognition from a distal side.

The present invention has been made in view of the circumstance described above, and it is an object of the present invention to provide a vehicle headlamp that is capable of optically distributing a spot portion of a light distribution pattern having a cutoff line to a cruising lane side.

SUMMARY OF THE INVENTION

A vehicle headlamp according to first aspect of present invention, comprising:

a semiconductor-type light source; and a lens adapted to forwardly radiate light from the semiconductor-type light source as a light distribution pattern having a cutoff line; wherein the lens is made of an incident surface in which the light from the semiconductor-type light source is incident into the lens and an emission surface from which the light that is incident into the lens is emitted, the incident surface of the lens is formed in a convex shape that is gently protrudes to a side of the semiconductor-type light source, the incident surface being made of a free curved surface, the emission surface of the lens is formed in a convex shape that is gently protrudes to an opposite side to a side of the semiconductor-type light source, the emission surface being made of a free curved surface, on the incident surface of the lens, a peak portion that forms a spot portion of the light distribution pattern is provided in a given location that is close to a cruising lane side with respect to an optical axis of the lens.

The vehicle headlamp according to second aspect of the present invention, wherein the emission surface of the lens is transversely symmetrical to the optical axis of the lens.

The vehicle headlamp according to third aspect of the present invention, wherein the incident surface of the lens is formed in a gradient shape that tilts from a front side of a vehicle to a rear side of the vehicle, over from an inside of the vehicle to an outside of the vehicle.

The vehicle headlamp according to the first aspect of the present invention is provided in such a manner that a peak portion is provided in a given location that is close to a cruising lane side with respect to an optical axis of a lens within an incident surface of the lens; and therefore, a spot portion can be optically distributed to the cruising lane side from among light distribution patterns. In this manner, visual recognition on a distal side of the cruising lane side is improved, making it possible to contribute to traffic safety.

The vehicle headlamp according to the second aspect of the present invention is provided in such a manner that an emission surface of a lens is transversely symmetrical to an optical axis of the lens. As a result, when lenses of the vehicle headlamps that are respectively mounted (equipped) at the left and right of a front part of a vehicle are visually seen (viewed) from a front side of the vehicle, the emission surfaces of the lenses are transversely symmetrical to the optical axis of the vehicle in single lenses, respectively, and moreover, the emission surfaces each are transversely symmetrical to a center of the vehicle; and therefore, an appearance of an external view is improved without feeling an unnatural sense of the external view.

The vehicle headlamp according to the third aspect of the present invention is provided in such a manner that an incident surface of a lens is formed in a gradient shape that tilts from a front side of a vehicle to a rear side of the vehicle, over from an inside of the vehicle to an outside of the vehicle. As a result, a shape of a planer view of the lens can be formed in such a shape that a thickness from an optical axis of the lens to the outside of the vehicle is larger than a thickness from the optical axis of the lens to the inside of the vehicle; and therefore, both of left and right end parts of a light distribution pattern can be increased in width to the outside of both of the left and right, and a light distribution pattern having an ideal cutoff line can be obtained.

DESCRIPTION OF THE PREFERRED EMBODIMENTS

Hereinafter, two examples of the preferred embodiments (the exemplary embodiments) of vehicle headlamps according to the present invention will be described in detail with reference to the drawings. It is to be noted that the present invention is not limited by the embodiments. In the present specification, the terms "front", "rear", "top", "bottom", "left", and "right" respectively designate the front, rear, top, bottom, left, and right that are defined when the vehicle headlamp according to the present invention is mounted on a vehicle. In addition, a combination of uppercase letters with hyphen "VU-VD" designates a vertical line from the top to bottom of a screen, and a combination of uppercase letters with hyphen "HL-HR" designates a horizontal line from the left to right of the screen.

Description of Configuration of First Embodiment

Figure 1:
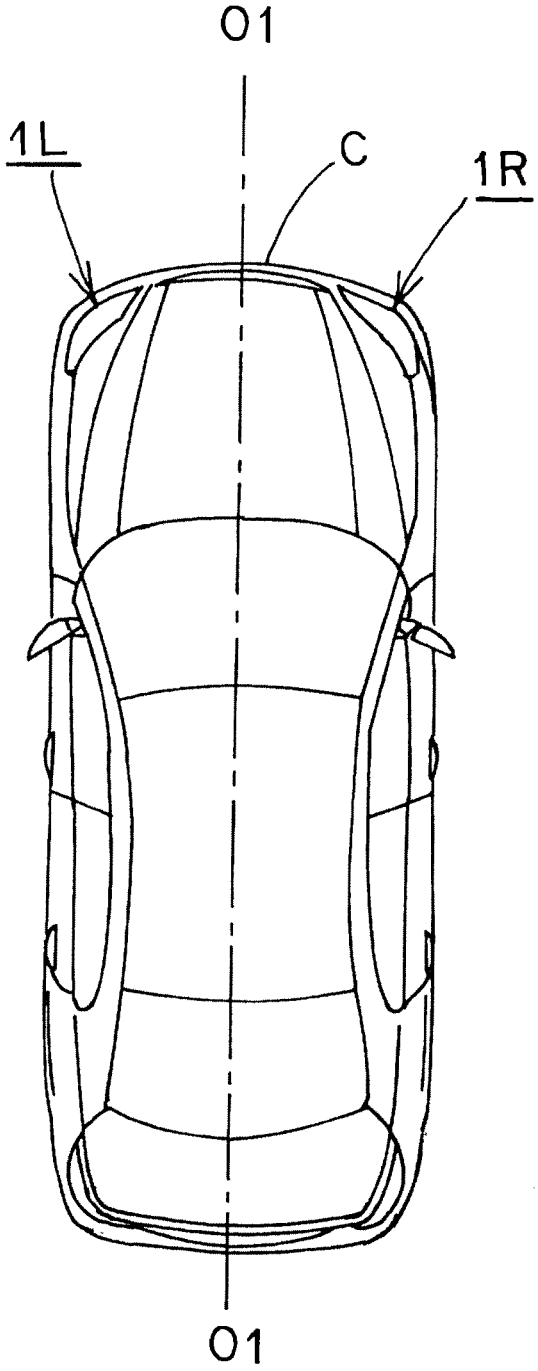
FIG. 1 shows a vehicle headlamp according to a first embodiment of the present invention, and is a plan view of a vehicle mounting both of the left and right vehicle headlamps thereon.
Figure 2:
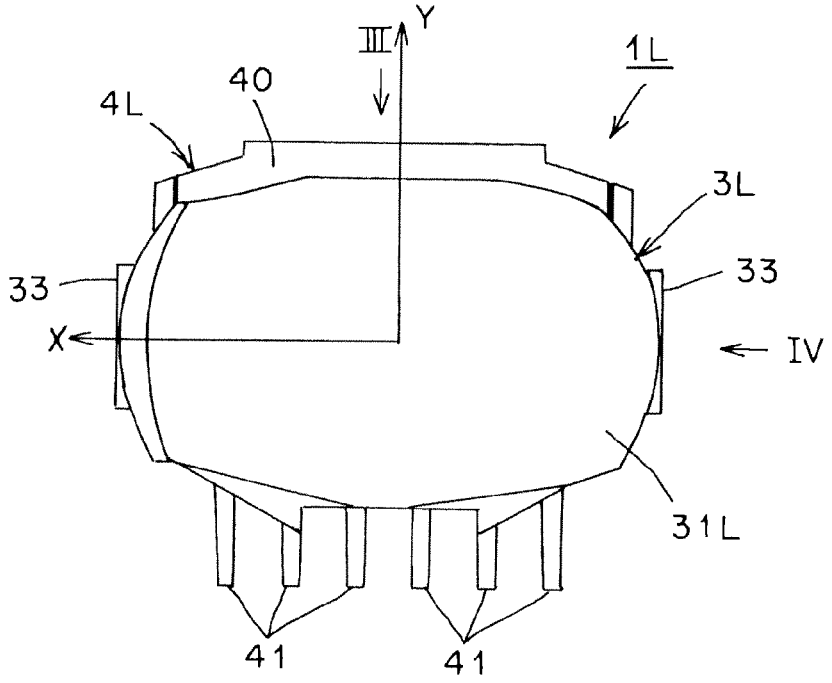
FIG. 2 is a front view showing a left side lamp unit.
Figure 3:
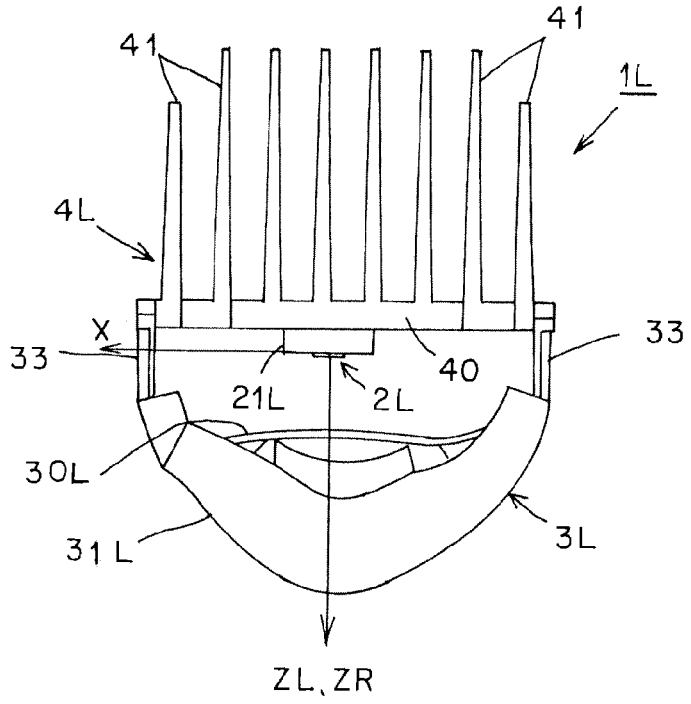
FIG. 3 is a plan view showing the left side lamp unit (a view taken along the arrow III in FIG. 2)
Figure 4:
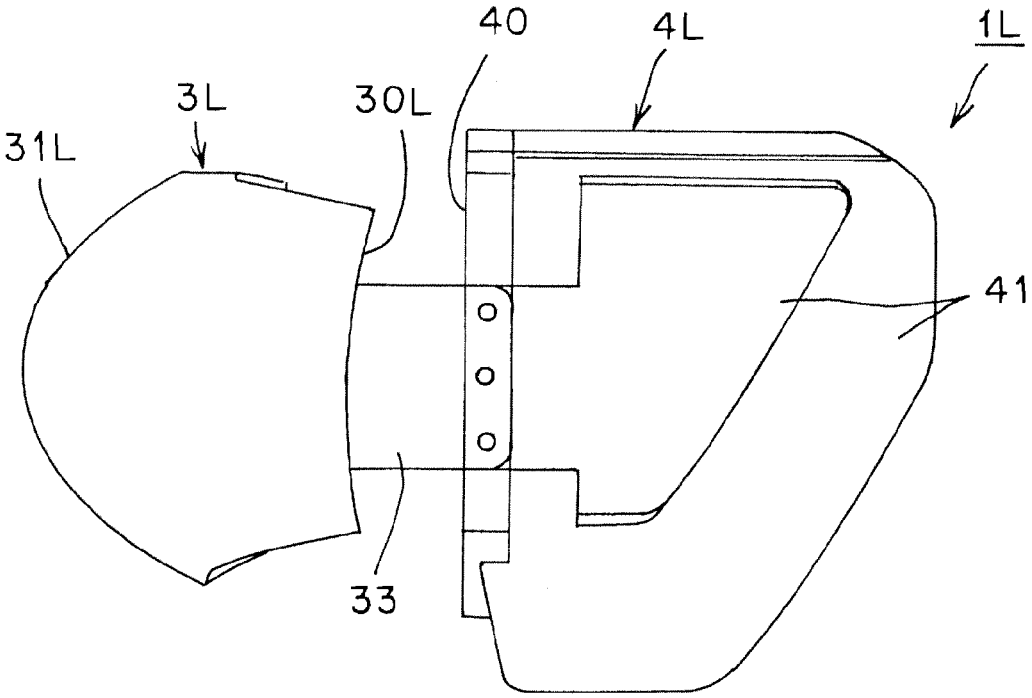
FIG. 4 is a right side view showing the left side lamp unit (a view taken along the arrow IV in FIG. 2)
Figure 5:
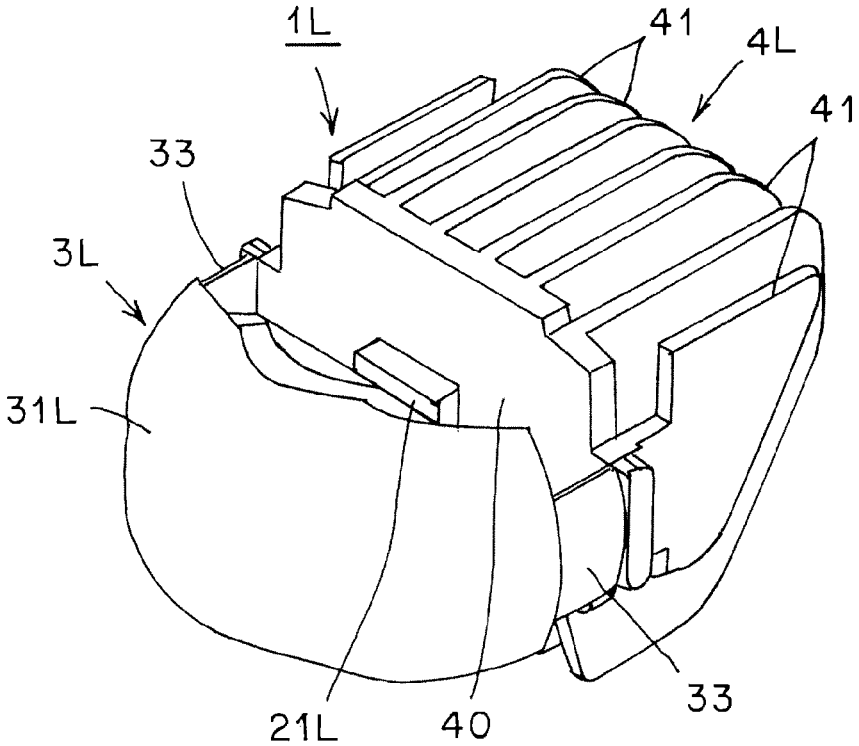
FIG. 5 is a perspective view showing the left side lamp unit.

FIG. 1 to FIG. 9 shows vehicle headlamps according to a first embodiment of the present invention. Hereinafter, a configuration of the vehicle headlamps in the first embodiment will be described. In FIG. 1, reference numerals 1L and 1R respectively designate vehicle headlamps (such as headlamps, for example) in the exemplary embodiment. The vehicle headlamps 1L and 1R are respectively mounted on both of the front left and right end parts of a vehicle C.

The vehicle headlamps 1L and 1R, as shown in FIG. 2 to FIG. 5, are provided with: a lamp housing (not shown); lamp lenses (not shown); semiconductor-type light sources 2L and 2R; lenses 3L and 3R; and a heat sink member 4L. It is to be noted that a heat sink member of the right side vehicle headlamp 1R is not shown because its structure is substantially identical to that of the heat sink member 4L of the left side vehicle headlamp 1L.

The semiconductor-type light source 2L and 2R, the lenses 3L and 3R and the heat sink 4L configure a lamp unit. The lamp housing and the lamp lens define a lamp room (not shown). The constituent elements 2L, 2R, 3L, 3R, and 4L of the above lamp unit are disposed in the lamp room, and are mounted on the lamp housing via an optical axis adjustment mechanism for vertical direction (not shown) and an optical axis adjustment mechanism for transverse direction (not shown).

The semiconductor-type light sources 2L and 2R, in this example, use a self-light semiconductor-type light source such as an LED or an EL (an organic EL), for example, and in other words, these light sources use a semiconductor-type light source (an LED in this exemplary embodiment). The semiconductor-type light sources 2L and 2R each are made of: a board (not shown); a light emitting chip 20 that is provided on the board; and a sealing resin member (not shown) that is adapted to seal the light emitting chip 20. The semiconductor-type light sources 2L and 2R are mounted on the heat sink 4L by means of mount members 21L and 21R, respectively. The light emitting chips 20 of the semiconductor-type light source 2L and 2R emit light beams when a current is supplied to the light emitting chip via the mount members 21L and 21R and the board.

Figure 6:
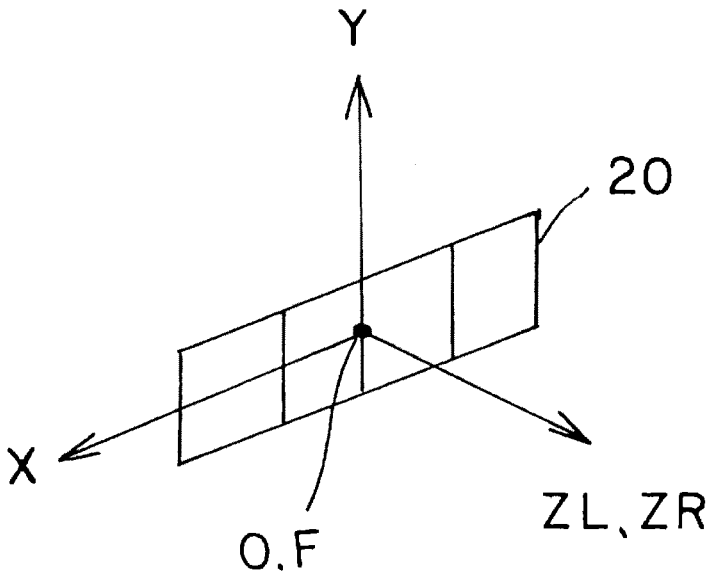
FIG. 6 is an explanatory perspective view showing a light-emitting chips of a semiconductor-type light source.

The light emitting chip 20, as shown in FIG. 6, is formed in a planer rectangular shape (a planer rectangle shape). In other words, four square chips are arranged in an X-axis direction (a horizontal direction). It is to be noted that one rectangle ship or one square chip may be used. The center O of the light emitting chip 20 is positioned at or near a reference focal point F of the lenses 3L and 3R and on or near reference optical axes (reference axes) ZL and ZR of the lenses 3L and 3R. The light emission surface of the light emitting chip 20 is oriented to the front side of the reference optical axes ZL and ZR of the lenses 3L and 3R.

In FIG. 6, the X, Y, ZL, and ZR axes configure an orthogonal coordinate (an X-Y-Z orthogonal coordinate system). The X axis corresponds to a horizontal axis in a transverse direction passing through the center O of the light emitting chip 20, and this axis is on a cruising lane side, and in other words, in the embodiment, the right side is in a positive direction, and the left side is a negative direction. In addition, the Y axis corresponds to a vertical axis in a vertical direction passing through the center O of the light emitting chip 20, and in the embodiment, the upper side is in a positive direction, and the lower side is a negative direction. Further, the Z axis corresponds to a normal line (a perpendicular line) passing through the center O of the light emitting chip 20, and in other words, this Z axis corresponds to an axis in a forward/backward direction orthogonal to the X axis and the Y axis, and in the embodiment, the front side is in a positive direction, and the rear side is in a negative direction.

Figure 7:
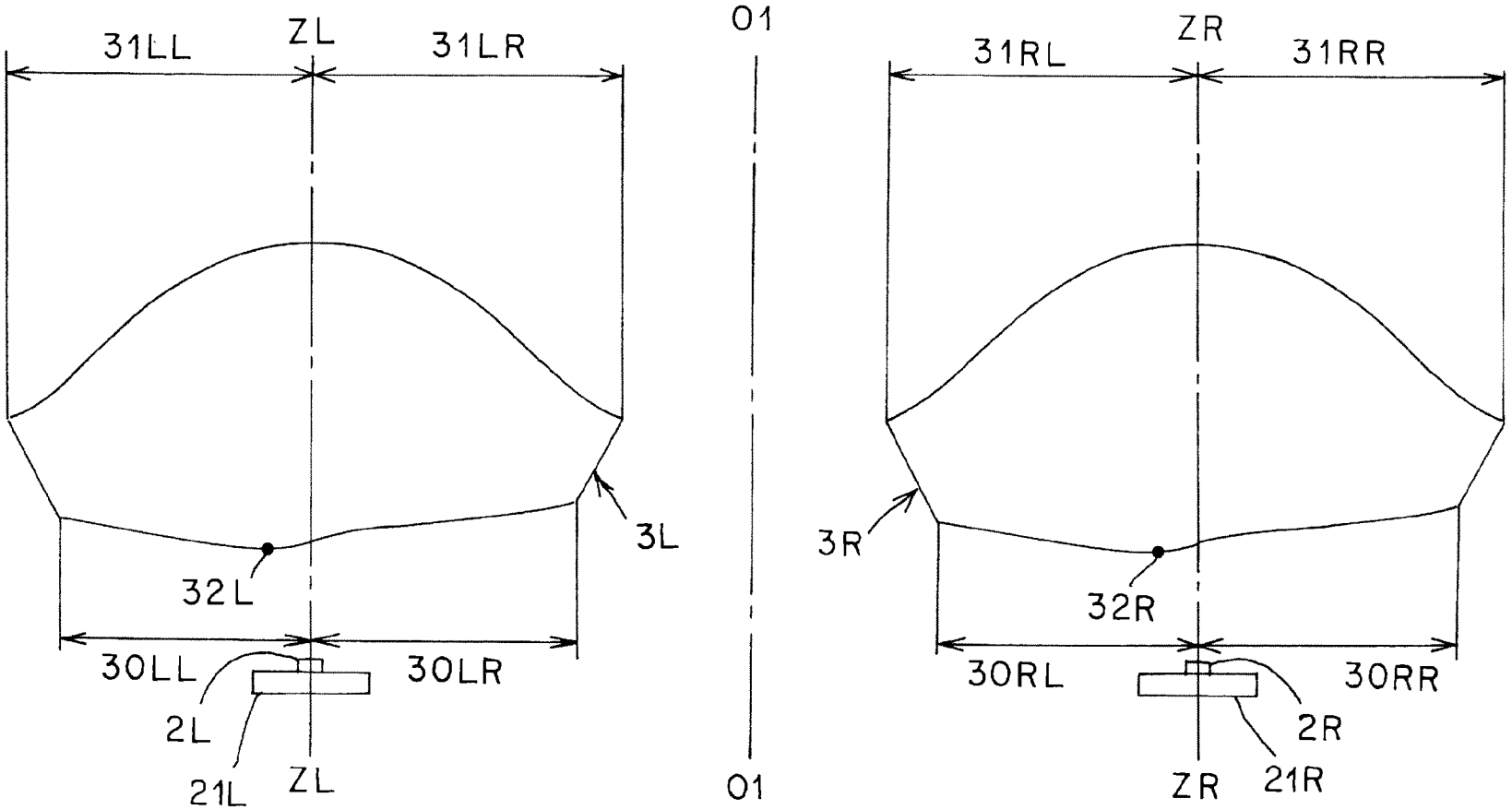
FIG. 7 is an explanatory perspective view showing a respective one of left and right side lenses.
Figure 8:
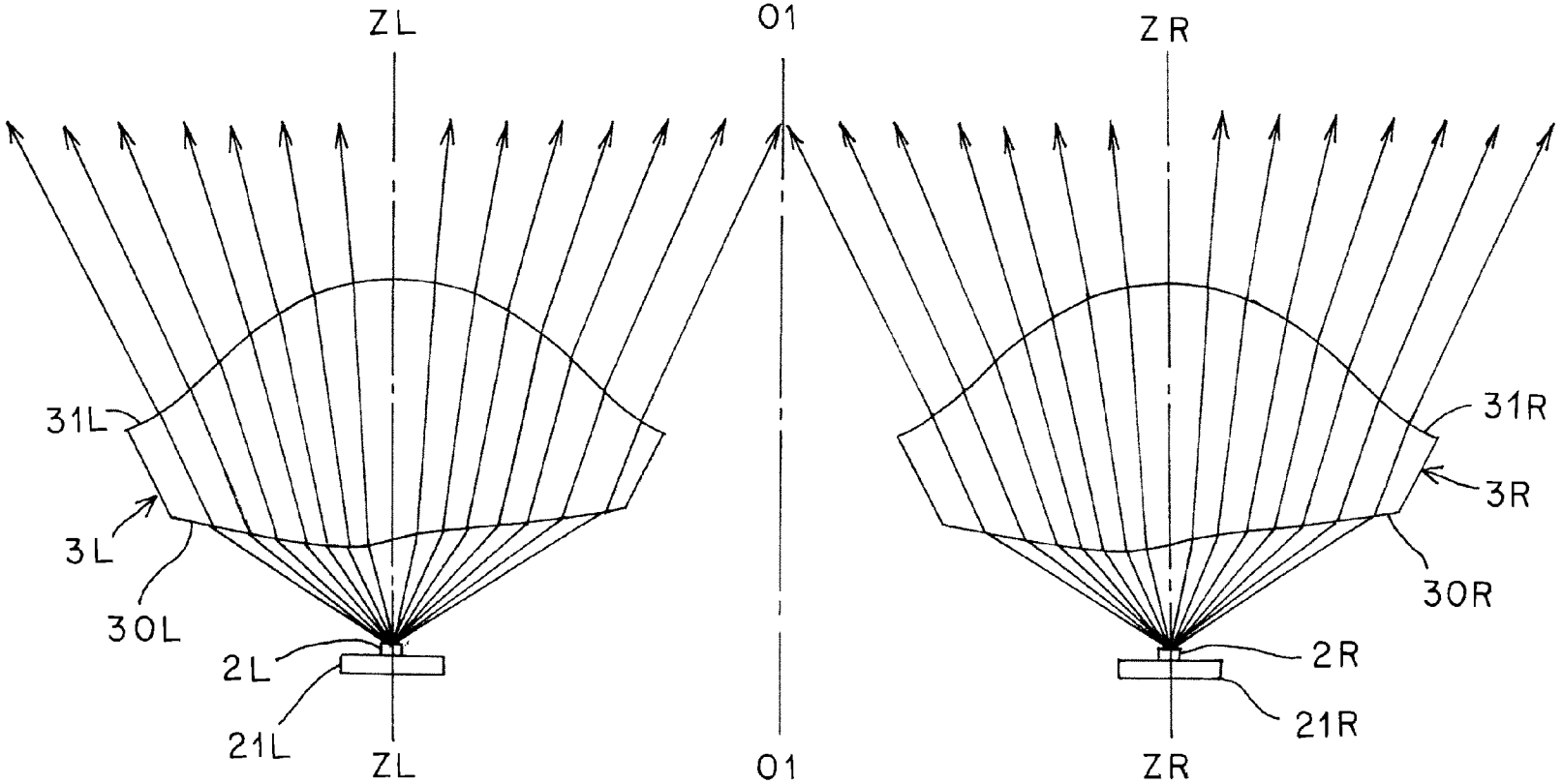
FIG. 8 is an explanatory perspective view showing an optical path of a respective one of the left and right side lenses.

The lenses 3L and 3R, as shown in FIG. 7 and FIG. 8, comprise respectively made of: incident surfaces 30L and 30R in which the light beams (see solid arrows in FIG. 8) from the semiconductor-type light sources 2L and 2R are incident into the lenses 3L and 3R; and emission surfaces 31L and 31R from which the light beams incident into the lenses 3L and 3R are emitted.

The incident surfaces 30L and 30R of the lenses 3L and 3R each are formed in a convex shape that gently protrudes to the side of a respective one of the semiconductor-type light source 2L and 2R, and these incident surfaces each are made of a free curved surface.

The incident surfaces 30L and 30R of the lenses 3L and 3R each are formed in a convex shape that gently protrudes to the side of a respective one of the semiconductor-type light source 2L and 2R, and these incident surfaces each are made of a free curved surface that is transversely symmetrical to a respective one of the optical axes ZL and ZR of the lenses 3L and 3R.

Figure 9:
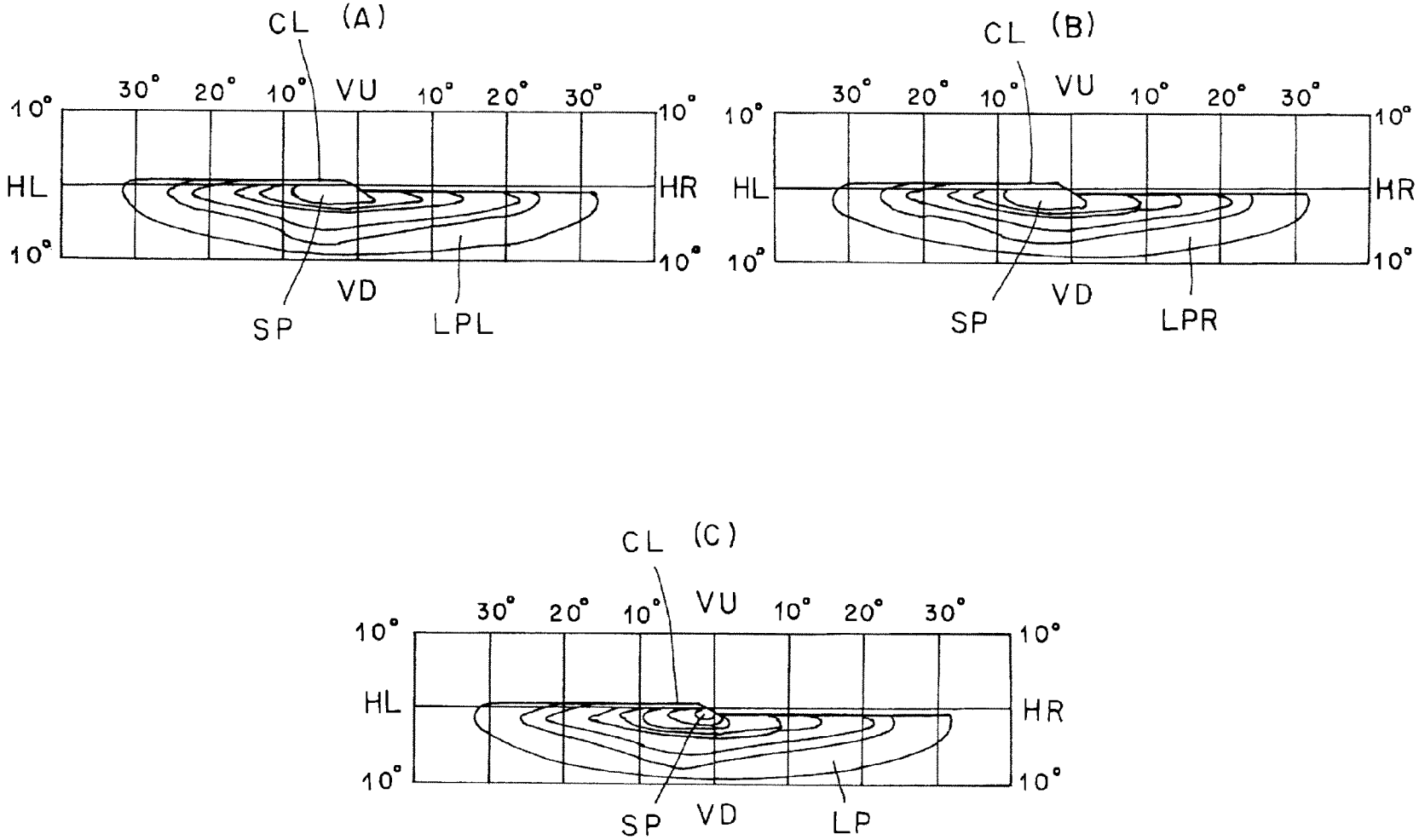
FIG. 9 is an explanatory view showing a light distribution pattern for low beam of a left side vehicle headlamp, a light distribution pattern for low beam of a right side vehicle headlamp, and a light distribution pattern for low beam having been obtained by overlapping both of the left and right vehicle headlamps.

On the incident surfaces 30L and 30R of the lenses 3L and 3R, peak portions 32L and 32R that form a spot portion SP of a light distribution pattern having a cutoff line CL shown in FIG. 9 (C), in this embodiment, the peak portions being those of a light distribution pattern for low beam (a light distribution pattern for passing) LP, are respectively provided on a cruising lane side with respect to the optical axis ZL and ZR of the lenses 3L and 3R, and in the embodiment, these peak portions are respectively provided in given locations that are close to the left side.

The peak portions 32L and 32R are respectively obtained as peak portions formed in a shape (refer to FIG. 7) of a planer view of the emission surfaces 31L and 31R of the lenses 3L and 3R (when visually seen from an upper side). A thickness in the forward/backward direction of the lenses 3L and 3R in the peak portions 32L and 32R becomes maximal.

Herein, left side portions 30LL and 30RL and right side portions 30LR and 30RR of the incident surfaces 30L and 30R of the lenses 3L and 3R are substantially transversely symmetrical to the optical axes ZL and ZR of the lenses 3L and 3R, respectively. Left side portions 31LL and 31RL and right side portions 31LR and 31RR of the emission surfaces 31L and 31R of the lenses 3L and 3R are transversely non-symmetrical to the optical axes ZL and ZR of the lenses 3L and 3R, respectively.

The heat sink member 4L is made of: a perpendicular plate portion 40; and a fin portion 41 that is formed in the shape of a plurality of perpendicular plates, the fin portion being integrally provided on one face (a rear side face) of the perpendicular plate portion 40. On the other face (a front side face) of the perpendicular plate portion 40 of the heat sink member 4L, the semiconductor-type light sources 2L and 2R are respectively mounted via the mount members 21L and 21R. On both of the side edges of the perpendicular plate portion 40 of the heat sink member 4L, the lenses 3L and 3R are mounted via a holder 33. The holder 33 may be integrated with the lenses 3L and 3R, or alternatively, this holder may be separated from these lenses.

Description of Functions of First Embodiment

The vehicle headlamps 1L and 1R in the first embodiment are respectively made of the constituent elements as described above, and hereinafter, related functions thereof will be described.

The light emitting chips 20 of the semiconductor-type light sources 2L and 2R are lit. Then, as indicated by the arrow drawn by the solid line in FIG. 8, the light beams from the light emitting chips 20 are respectively incident into the lenses 3L and 3R from the incident surfaces 30L and 30R of the lenses 3L and 3R. At this time, the incident light beams are controlled to be optically distributed in the incident surfaces 30L and 30R, respectively. The incident light beams that are incident into the lenses 3L and 3R are respectively emitted from the emission surfaces 31L and 31R of the lenses 3L and 3R. At this time, the emitted light beams are respectively controlled to be optically distributed in the emission surfaces 31L and 31R.

The emitted light from the left side lens 3L, as shown in FIG. 9 (A), is radiated forward of the vehicle C as a left side light distribution pattern for low beam LPL which has a cutoff line CL, and which has a spot portion SP on a left side of a cruising lane side, and further, which is substantially equal in spreading of both of the left and right end parts.

The emitted light from the right side lens 3R, as shown in FIG. 9 (B), is radiated forward of the vehicle C as a right side light distribution pattern for low beam LPR which has a cutoff line CL, and which has a spot portion SP on the left side of the cruising lane side, and further, which is substantially equal in spreading of both of the left and right end parts.

The left side light distribution pattern for low beam LPL and the right side light distribution pattern for low beam LPR are overlapped on each other, and as shown in FIG. 9 (C), a light distribution pattern for low beam LP is formed which has a cutoff line CL, and which has a spot portion SP on the left side of the cruising lane side, and further, which is substantially equal in spreading of both of the left and right end parts.

Description of Advantageous Effect of First Embodiment

The vehicle headlamps 1L and 1R in the first embodiment are respectively made of the constituent elements and functions as described above, and hereinafter, related advantageous effects thereof will be described.

The vehicle headlamps 1L and 1R according to the first embodiment are provided in such a manner that peak portions 32L and 32R are respectively provided in given locations that are close to a cruising lane side with respect to lens optical axes ZL and ZR of lenses 3L and 3R of the lens emission surfaces 31L and 31R of the lenses 3L and 3R, enabling a spot portion SP to be optically distributed on the cruising lane side from among the light distribution patterns LP. In this manner, visual recognition from a distal side on the cruising lane side is improved, making it possible to contribute to traffic safety.

The vehicle headlamps 1L and 1R in the first embodiment are characterized in that emission surfaces 31L and 31R of the lenses 3L and 3R are transversely symmetrical to the optical axes ZL and ZR of the lenses 3L and 3R, respectively. As a result, when the lenses 3L and 3R of the vehicle headlamps 1L and 1R that are respectively mounted (equipped) at the left and right of the front part of a vehicle C are visually seen (viewed) from a front side of the vehicle C, the emission surfaces 31L and 31R of the lenses 3L and 3R in the single lenses 3L and 3R are transversely symmetrical to the optical axes ZL and ZR of the lenses 3L and 3R, respectively, and moreover, these emission surfaces each are transversely symmetrical to a center O1-O1 of the vehicle C; and therefore, an appearance of an external view is improved without feeling an unnatural sense of the external view.

Description of Second Embodiment

Figure 10:
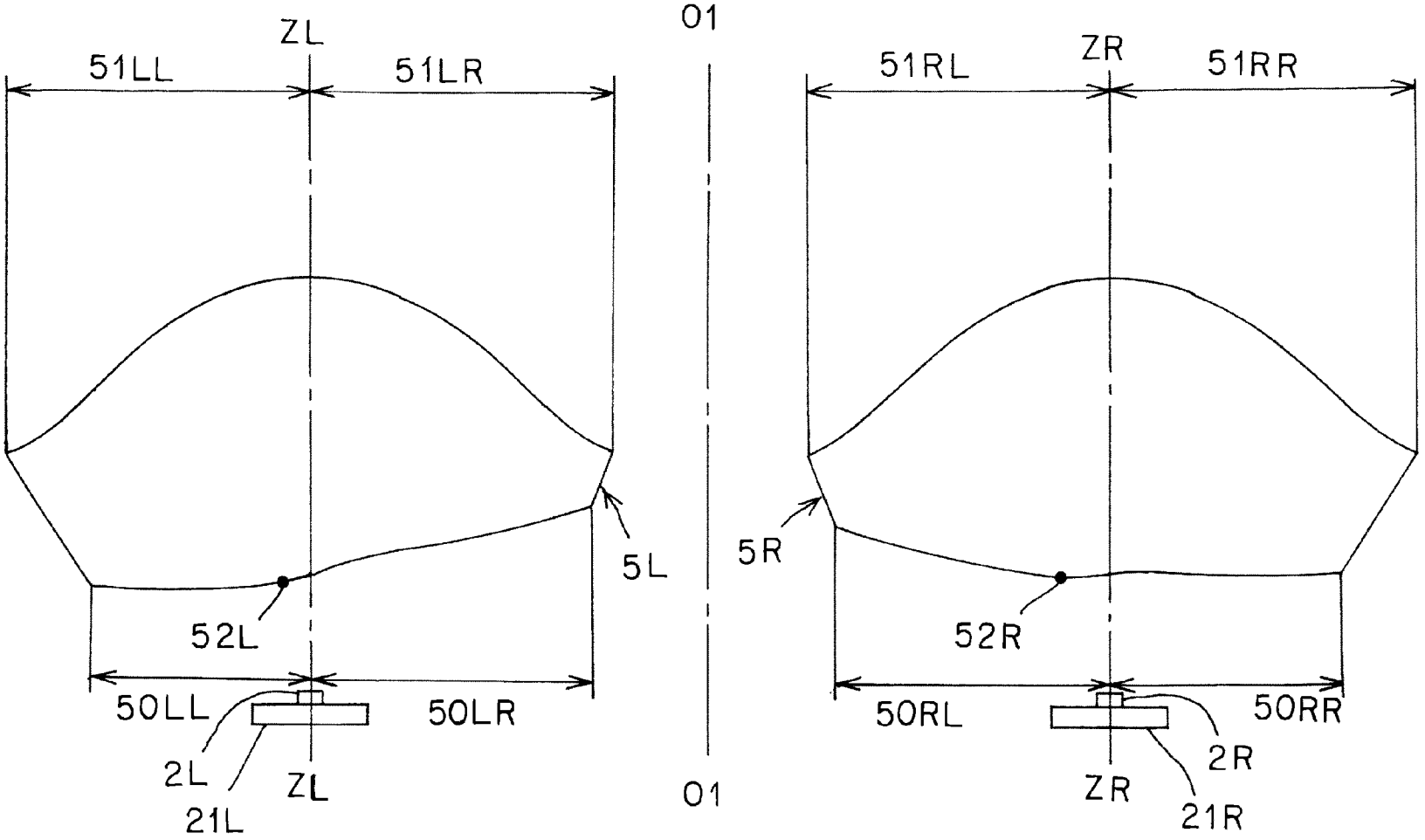
FIG. 10 is an explanatory plan view showing a respective one of the left and right lenses showing a vehicle headlamp according to a second embodiment of the present invention.
Figure 11:
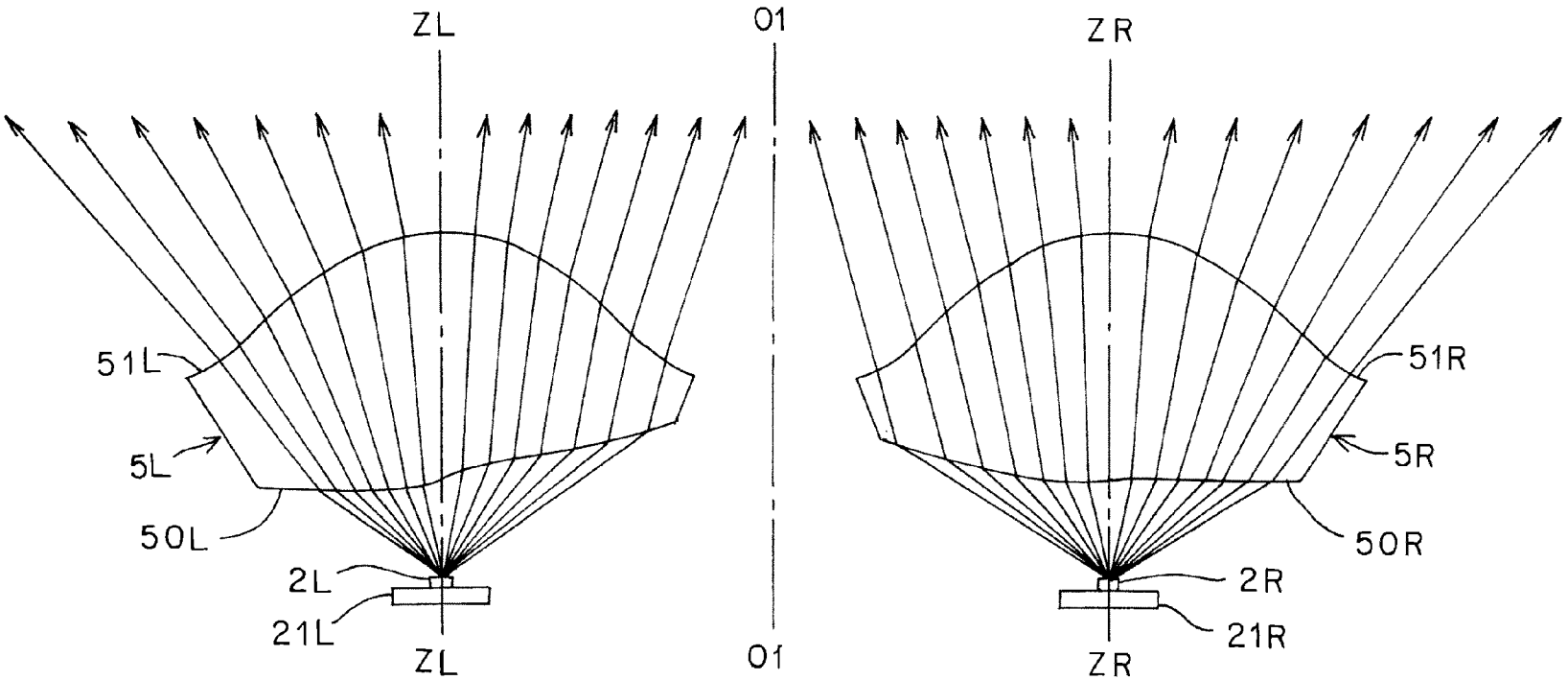
FIG. 11 is an explanatory plan view showing an optical path of a respective one of the left and right side lens.
Figure 12:
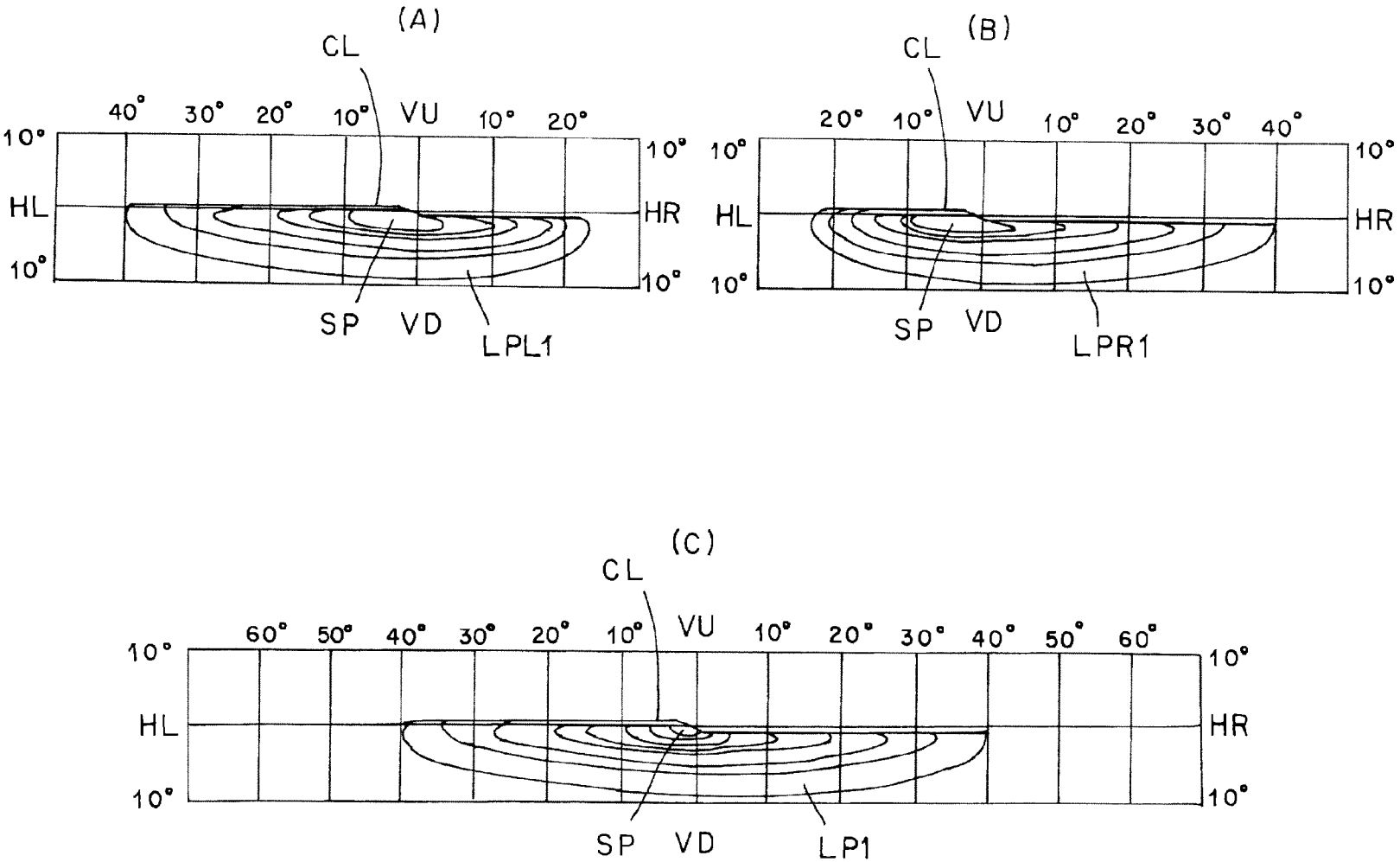
FIG. 12 is an explanatory view showing a light distribution pattern for low beam of a left side vehicle headlamp, a light distribution pattern for low beam of a right side vehicle headlamp, and a light distribution pattern for low beam having been obtained by overlapping both of the left and right vehicle headlamps.

FIG. 10 to FIG. 12 shows vehicle headlamps according to a second embodiment of the present invention. Hereinafter, the vehicle headlamps in the second embodiment will be described. In the figures, like constituent elements shown in FIG. 1 to FIG. 9 are designated by like reference numerals.

Lenses 5L and 5R of the vehicle headlamps in the second embodiment, as shown in FIG. 10 and FIG. 11, comprises: incident surfaces 50L and 50R in which light beams from the semiconductor-type light sources 2L and 2R (refer to the arrow drawn by the solid line in FIG. 11) are respectively incident into the lenses 5L and 5R; and emission surfaces 51L and 51R from which the light beams that are incident into the lenses 5L and 5R are emitted, respectively.

The incident surfaces SOL and 50R of the lenses 5L and 5R are respectively formed in a convex shape that gently protrudes to the side of the semiconductor-type light sources 2L and 2R, and these incident surfaces each are made of a free curved surface.

The emission surfaces 51L and 51R of the lenses 5L and 5R are respectively formed in a convex shape that gently protrudes to an opposite side to that of a respective one of the semiconductor-type light sources 2L and 2R, and these incident surfaces each are made of a free curved surface that is transversely symmetrical to a respective one of the optical axes ZL and ZR of the lenses 3L and 3R.

On the incident surfaces 50L and 50R of the lenses 5L and 5R, peak portions 52L and 52R that form a spot portion SP of a light distribution pattern having a cutoff line CL shown in FIG. 12 (A), FIG. 12 (B), and FIG. 12 (C), in the embodiment, the peak portions being those of light distribution patterns (light distribution patterns for passing) LP1, LPL1, and LPR1, are respectively provided on the cruising lane side with respect to the optical axes ZL and ZR of the lenses 5L and 5R, and in the embodiment, these peak portions are respectively provided in given locations that are close to the left side.

The peak portions 52L and 52R are respectively obtained as peak portions in a shape (refer to FIG. 10) of a planar view of the emission surfaces 51L and 51R of the lenses 5L and 5R (which is visually seen from an upper side). A thickness (a length) in the forward/backward direction of a respective one of the lenses 5L and 5R in the peak portions 52L and 52R becomes maximal.

Herein, left side portions 50LL and 50RL and right side portions 50LR and 50RR of the incident surfaces 50L and 50R of the lenses 5L and 5R are substantially transversely symmetrical to the optical axes ZL and ZR of the lenses 5L and 5R, respectively. Left side portions 51LL and 51RL and right side portions 51LR and 51RR of the emission surfaces 51L and 51R of the lenses 5L and 5R are transversely non-symmetrical to the optical axes ZL and ZR of the lenses 5L and 5R, respectively.

The incident surface 50L, 50R of the lens 5L, 5R is formed in a gradient shape that tilts from a front side of the vehicle to a rear side of the vehicle, over from an inside of the vehicle to an outside of the vehicle. In the words, the incident surface 50L of the lens 5L on the left side is inclined from the front side vehicle to the rear side of vehicle, over a right side portion 50 LR to a left side portion 50 LL. On the other hand, the incident surface 50R of the lens 5R on the right side is inclined from the front side vehicle to the rear side of vehicle, over the left side portion 50 RL to the right side portion 50 RR.

In the shape of the planer view of the lenses 5L and 5R (which is visually seen from an upper side), a thickness of the outside of a vehicle from the optical axes ZL and ZR of the lenses 5L and 5R (in other words, a thickness (a length) in the forward/backward direction from the left side portion 50LL of the incident surface SOL of the left side lens 5L to the left side portion 50LL of the emission surface 51L) and a thickness (a length) in the forward/backward direction from the right side portion 51RR of the incident surface 50R of the lens 5R to the right side portion 51RR of the right side lens 5R) are larger than a thickness of the inside of the vehicle from optical axes ZL and ZR of the lenses 5L and 5R (in other words, a thickness (a length) in the forward/backward direction from the right side portion 50LR of the incident surface 50L of the left side lens 5L to the right side portion 51LR of the emission surface 51L and a thickness (a length) in the forward/backward direction from the left side portion 50RL of the incident surface 50R of the right side lens 5R to the left side portion 51RL of the emission surface 51R.

The vehicle headlamps in the second embodiment are respectively made of the constituent elements as described above, thus making it possible to achieve functions and advantageous effects that are substantially similar to those of the vehicle headlamps 1L and 1R in the first embodiment described previously.

In particular, the vehicle headlamps in the second embodiment are characterized in that the incident surfaces SOL and 50R of the lenses 5L and 5R each are formed in a gradient shape that tilts from a front side of a vehicle to a rear side of the vehicle, over from an inside of the vehicle to an outside of the vehicle. Thus, according to the vehicle headlamps in the second embodiment, the shape in a planer view of the lenses 5L and 5R can be formed in a shape in which a thickness from the optical axes ZL and ZR of the lenses 5L and 5R to the outside of the vehicle is larger than a thickness from the optical axes ZL and ZR of the lenses 5L and 5R to the inside of the vehicle. In this manner, according to the vehicle headlamps in the second embodiment, as shown in FIG. 12 (A), FIG. 12 (B), and FIG. 12 (C), both of the left and right end parts of a light distribution pattern can be increased in width to the outside of both of the left and right, and light distribution patterns for low beams LP1, LPL1, and LPR1, at least one of which has an ideal cutoff line, can be obtained.

Moreover, the vehicle headlamps in the second embodiment are characterized in that the emission surfaces 51L and 51R of the lenses 5L and 5R are transversely symmetrical to the optical axes ZL and ZR of the lenses 5L and 5R, respectively. As a result, when the lenses 7L and 7R of the left and right vehicle headlamps that are mounted on the vehicle are visually seen from a front side of the vehicle, these lenses each are further transversely symmetrical to the center of the vehicle; and therefore, an appearance of an external view is further improved without feeling a further unnatural sense of the external view.

Description of Examples Other than First and Second Embodiments

The first, second, third, and fourth embodiments have described vehicle headlamps 1L and 1R in a case where a vehicle C cruises on a left side. However, the present invention can be applied to vehicle headlamps in a case where the vehicle C cruises on a right side.

In addition, in the first and second embodiments, the emission surfaces 31L, 31R, 51L and 51R of the lenses 3L, 3R, 5L, and 5R are transversely symmetrical to the optical axes ZL and ZR of the lenses 3L, 3R, 5L, and 5R, respectively. However, in the present invention, an emission surface of a lens may be transversely symmetrical to an optical axis of the lens.

What is claimed is:

1. A vehicle headlamp comprising:

a semiconductor light source; and a lens, having an optical axis along a forward direction, configured to forwardly radiate light from the semiconductor light source as a light distribution pattern having a cutoff line; wherein the lens is made of an incident surface in which the light from the semiconductor light source is incident into the lens and an emission surface from which the light that is incident into the lens is emitted, the incident surface of the lens is formed in a convex shape that is gently protruding to a side of the semiconductor light source, the incident surface being made of a free curved surface, the emission surface of the lens is formed in a convex shape that is gently protruding to an opposite side to the side of the semiconductor light source, the emission surface being made of a free curved surface, on the incident surface of the lens, a peak portion that forms a spot portion of the light distribution pattern is provided, the peak portion having a peak point in a given location that is on a left side or a right side with respect to the optical axis of the lens, wherein the incident surface of the lens is transversely nonsymmetrical to the optical axis of the lens, and wherein the emission surface of the lens is transversely symmetrical to the optical axis of the lens.

2. The vehicle headlamp according to claim 1, wherein the incident surface of the lens is inclined from a front side of a vehicle to a rear side of the vehicle, from a right side of the lens to a left side of the lens.

3. The vehicle headlamp according to claim 1, wherein the incident surface of the lens is inclined from a front side of a vehicle to a rear side of the vehicle, from a left side of the lens to a right side of the lens.

4. The vehicle headlamp according to claim 1, wherein the incident surface of the lens is transversely nonsymmetrical to the optical axis of the lens along a direction from a left side of the lens to aright side of the lens.

* * * * *